United States Patent [19]

Grabner et al.

[11] Patent Number: 4,944,497

[45] Date of Patent: Jul. 31, 1990

[54] FLUSHING BLOCK

[75] Inventors: Bernd Grabner, Millstatt, Austria; Lorenz Dötsch, Vallendar, Fed. Rep. of Germany; Josef Knauder, Eitweg, Austria; Hans Höffgen, Hör-Grenzhausen, Fed. Rep. of Germany

[73] Assignee: Radex-Heraklith Industriebeteilgungs AG, Austria

[21] Appl. No.: 326,295

[22] Filed: Mar. 21, 1989

[30] Foreign Application Priority Data

Mar. 23, 1988 [DE] Fed. Rep. of Germany ..... 3809828

[51] Int. Cl.[5] ..... C21B 7/072

[52] U.S. Cl. ..... 266/268; 222/603

[58] Field of Search ..... 266/236, 266, 267, 268, 266/270; 222/598, 601, 602, 603

[56] References Cited

U.S. PATENT DOCUMENTS

| | | | |
|---|---|---|---|
| 3,556,360 | 1/1971 | Stelson | 222/601 |
| 3,574,341 | 4/1971 | Fehling et al. | 222/601 |
| 3,802,683 | 4/1974 | Lee et al. | 222/601 |

*Primary Examiner*—S. Kastler

*Attorney, Agent, or Firm*—John F. A. Earley; John F. A. Earley, III; P. Michael Walker

[57] ABSTRACT

The invention relates to a flushing block for introducing gaseous and/or solid reagents and additives into a metallurgical melting vessel, which is connectable at one end to a gas pipe and at least to a drive means and at its other end has at least one outlet opening extending from its circumferential surface, said opening terminating in at least one gas channel which can be connected to the gas pipe.

16 Claims, 4 Drawing Sheets

FLUSHING BLOCK

Figure 1A:
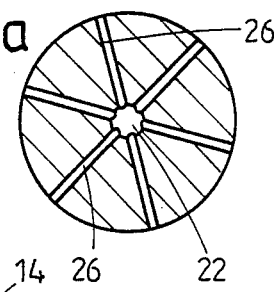

The invention relates to a flushing block introducing gases and/or solid reagents and additives into a treatment vessel for metallurgical melts.

Flushing blocks are preferably inserted in the wall or base of a metallurgical treatment vessel (for example an electric furnace, converter, tundish, ladle, iron runner, vacuum furnace, degassing vessel), usually by means of a sleeve block. Solids, however finely divided, cannot be blown through known gas flushing blocks as described, for example, in "Radex Rundschau, 1987, 288", because the fine porosity of these gas flushing blocks would rapidly cause blockage and thus render the apparatus inoperable.

For example, DE-OS No. 35 20 207 describes a flushing block which is intended for blowing gases or solids into a ladle containing a molten metal. For this purpose the flushing block has a large central through passage. An apparatus of this kind cannot be used in practice because, with a through-passage of this size, molten metal would easily penetrate into the flushing block and destroy the equipment.

There is an urgent need to inject solids also into the molten metal, for example:

- for desulphurising with fine lime or mixtures of fine lime and soda, as well as calcium carbide ($CaC_2$) or calcium cyanamide ($CaCN_2$);
- for desilicating and dephosphorising in an iron runner, with lime *inter alia;*
- for feeding carbon dust in during smelting in the converter after decarburisation;
- for feeding carbon into the melt in an electric arc furnace.

Whereas it is possible to apply continuous gas pressure to a flushing system in fixed melting, refining or treatment apparatus, it is not possible in a transporting vessel such as a ladle, for example, to supply a gas flushing system with gas throughout the entire time that the melt is in the vessel. In such cases, so-called smelting or dipping lances are frequently used, through which solids can be blown as well. Apparatus of this kind are described, *inter alia* in German Utility Models 86 22 299 and 86 26 930. The part of the smelting lance immersed in the molten metal is subjected to considerable thermal and mechanical stress, to which reference is made several times in the Utility Models. However, if for example cracks reach the core of the lance, the smelting lance becomes unusable and has to be replaced. The discarded lance cannot be used again, even though a substantial part of its casing might still be fit for use.

A multi-part flushing block in which a valve is formed is known from U.S. Pat. No. 4,470,582. This flushing block is of complicated structure and it is impossible to blow any solids through it as the valve would become blocked.

The above-mentioned flushing elements cannot be used to blow oxygen, for example, in a converter, as the burning damage (wear) would be too great.

The aim of the invention is to provide a flushing block for introducing gases, particularly inert gases and/or solid reagents and additives in the form of powder or wire, which is of simple construction, provides a satisfactory method of metering even when used for transporting vessels and is as versatile as possible.

The invention is based on the recognition that the flushing blocks known hitherto have the disadvantages described particularly because they are fixedly mounted in associated sleeve blocks and are consequently in direct communication with the molten metal via the porous section or the corresponding gas channels, irrespective of the particular gas pressure. There is then immediately the danger of infiltration of molten metal as soon as the gas pressure applied falls below the ferrostatic pressure of the molten metal.

The invention further recognises that this disadvantage can be overcome by constructing the gas flushing block in such a way that it is mounted so as to be axially movable in the base or wall of a metallurgical treatment vessel.

In its most general embodiment, the invention describes a flushing block for introducing gaseous and/or solid reagents and additives into a metallurgical melting vessel which can be connected at one end to a gas pipe and at least one drive means and has at its other end at least one outlet opening extending from the circumferential surface and terminating in at least one supply channel which is connectable to the gas and/or solids duct.

Where the specification refers to "above" or "below" or of the "upper" and "lower" end, this refers to the arrangement of the flushing block in a metallurgical treatment vessel. Accordingly, in a base-type arrangement the top will always be the side directly facing the molten metal.

The fundamental difference between this and conventional flushing blocks is the fact that the flushing block now has, at the end which will later be closest to the molten metal, at least one outlet opening through which, for example, an inert gas such as argon can be injected into the molten metal. This is, of course, only possible when the flushing block is arranged in the sleeve block in such a way that at least one outlet opening is located above the sleeve block in the region of the molten metal, whilst closure can be achieved by lowering the flushing block and hence its outlet opening until the outlet opening abuts tightly against the inner wall of the flushing block.

In principle, two different arrangements between the flushing block and the sleeve block are possible. In a first alternative embodiment, the flushing block is constructed as a stopper which, at its lower end, where a stopper would have its stopper head, has the above-mentioned outlet opening(s), whilst the gas/solids channel extends upwardly from the region of the outlet opening or openings and above the level of the molten metal the apparatus is then hinged to a suitable retaining and displacing apparatus, on the one hand, and to a gas and/or solids supply line, on the other.

Depending on whether the lower part of the apparatus is completely lowered into the associated sleeve block of the metallurgical vessel or projects upwardly into the molten metal with one or more outlet openings above the sleeve block, the gas fed in through the gas pipe may, for example, be fed into the molten metal or else the supply of gas will be interrupted. The important point is that at least the free lower end of the apparatus is always situated in the associated sleeve block and consequently the apparatus as a whole is securely guided. In one embodiment having a plurality of outlet openings with different (axial) associations, different quantities of gas (corresponding to the number of outlet openings which are open to the molten metal) can be injected into the molten metal, depending on how far the apparatus is pushed into the associated sleeve block.

It is also possible for the outlet openings to be in the shape of slots (in the axial direction of the flushing block). If the slots then project only partially above the sleeve block into the molten metal, less gas or solids flow into the melt than if the slots were totally exposed, since the cross-section of flow is smaller in the former case.

In the second alternative embodiment, the outlet opening or openings is or are provided at the upper end of the flushing block, whilst the remainder of the flushing block projects downwardly out of the sleeve block and the gas channel also extends to the lower end of the stopper where it is connected to a gas pipe. Then, obviously, below the base of the metallurgical melt vessel there is provided a displacing device for lifting the flushing block upwards out of its sealing position relative to the sleeve block and thereby either expose the outlet openings or lower them and return them to a sealed position relative to the sleeve block.

In the light of the above remarks it is readily apparent that the cross-sectional shape of the flushing block must correspond to that of the sleeve block, at least in the region of the outlet opening or openings, so that the flushing block can be guided in the sleeve block without play, with the corresponding surfaces abutting. This reliably prevents molten metal from escaping laterally in uncontrolled manner between the flushing block and the sleeve block. Preferably, the flushing block and the sleeve block are constructed, at their corresponding sections, with a circular cross-section, which is the optimum both in terms of manufacture and with regard to the sealing function. However, oval or rectangular cross-sectional shapes would also be possible.

Further embodiments of the flushing block will be described hereinafter. However, an additional application of the flushing block will first be described, which is of particular use if the flushing block projects into a sleeve block from below.

In an advantageous embodiment of the invention, at least one further channel extends axially upwards towards the molten metal from the lower end, this channel merging, at a spacing from its open lower end, into at least one feed opening which opens towards the circumferential surface.

This additional channel or the associated feed openings respectively serve not to supply gases or solid reagents and additives but to convey molten metal.

In accordance with the previous description of the arrangement of the flushing block in the associated sleeve block, in this embodiment the flushing block may simultaneously assume the function of a closure/outlet member for the molten metal. In the "raised" position not only are the outlet openings for the gas and/or solids in direct communication with the molten metal but also the above-mentioned feed openings, through which molten metal runs into the flushing block and is then carried away through the additional channel out of the metallurgical melting vessel. Conversely, in the "lowered" position of the flushing block a closed position is achieved because the feed openings are now no longer in communication with the molten metal but abut on the corresponding wall of the sleeve block to form a seal.

Although it is theoretically possible to arrange the different channels/openings for the gas and the molten metal in such a way that they open into each other, in a preferred embodiment the gas channel and the outlet opening or openings are arranged at a spacing from the other channel and the associated feed openings. Depending on the height at which the particular feed/outlet openings are arranged (viewed in the axial direction of the flushing block), it is possible either to carry out flushing operations only (which will include, according to the invention, the introduction of corresponding solid reagents and additives through this passage or another passage) or only to convey molten metal out of the metallurgical melting vessel or—as is particularly preferred—to combine both operations.

If according to an advantageous embodiment of the invention the feed openings and/or outlet openings extend substantially radially from the circumferential surface of the flushing block and the associated gas channel or the additional channel are arranged axially, there are possible embodiments in which the gas channel extends substantially parallel to the additional channel but the gas channel ends in a different plane (viewed in the axial direction) and may then possibly extend between the feed channels of the additional channel or vice versa.

The following are some of the features which develop the flushing block as an outlet means for the molten metal:

- Instead of a cylindrical channel it may taper conically towards the lower outlet end, so that the stream of cast metal can be centred.
- If the feed openings, viewed in the axial direction of the flushing block, are formed with an elongate mouth, with the upper and/or lower end preferably tapering in a wedge-shape, the regulating characteristics and outflow behaviour of the molten metal will be improved.
- If the feed openings have a certain inclination towards the outlet end of the flushing block, this ensures that all the residual melt flows downwards even in the closed position.
- An additional sealing surface can be created by constructing the flushing block, on its portion provided with feed openings, with a frustoconical portion which tapers towards the open lower end of the additional channel.
- In an embodiment in which the gas flushing block is introduced from above, it is advantageous to construct the flushing block with a bell-like thickened portion above the portion containing the feed openings. This avoids an outflow vortex inside the metallurgical melting vessel or at least substantially reduces any vortex and consequently prevents any non-metallic inclusions from being carried along. This also ensures a substantially horizontal inflow of molten metal into the lateral feed openings. This embodiment can also be adopted for a gas flushing block which projects into the sleeve block from below, the bell-shaped portion always remaining above the upper end of the sleeve block.
- If the flushing block is inserted from below and a displacing apparatus is provided below the sleeve block, it is possible to connect a dip or blind tube directly, which may even be integral with the flushing block.

The features recited above offer substantially the same advantages in terms of the channels for conveying gas or for introducing solid reagents and additives.

For the alternative embodiment in which the displacing apparatus for the flushing block is arranged underneath the sleeve block, the invention offers a particularly advantageous embodiment for the displacing apparatus. To this end, it is proposed that the displacing apparatus (actuating means) be made up of a plurality of pre-stressed pneumatic cylinders which, when a predetermined pressure is reached, move the flushing block so far upwards that the outlet openings and/or supply openings are exposed relative to the melt in the metallurgical melting vessel and, when the pressure falls, lower the flushing block so that its outlet openings and/or feed openings abut closely on the refractory material of the base which receives the flushing block or the wall (i.e. relative to the sleeve block) of the metallurgical vessel. The pneumatic cylinders preferably have a cylinder in which there are springs articulated to a piston.

Preferably, the pneumatic cylinder is acted upon with pressurised gas from the same gas pipe which also opens into the gas channel. The prestressing of the pneumatic cylinder is preferably adjusted so that the gas pressure required to raise the flushing block is at least 30%, preferably at least 50% higher than the ferrostatic pressure on the corresponding base or wall of the metallurgical melting vessel.

This means that the flushing block is only released from its closed position relative to the sleeve block into the "open" position when a corresponding gas pressure is applied through the gas pipe. Conversely, this means that the flushing block automatically falls back into the closed position as soon as the gas pressure in the gas pipe or gas channel falls back below the level specified.

Thus, the invention provides a quasi-automatically operating displacing apparatus and at the same time ensures that gas flushed in through the gas channels is always at a pressure above the ferrostatic pressure and consequently the infiltration of molten metal into the outlet openings is reliably prevented.

This embodiment of the flushing block will be explained in more detail with reference to the accompanying drawings.

The flushing block according to the invention makes it possible not only to flush gases into the molten metal but also to inject solid reagents and additives into it, particularly in powder form, either together with the gas or through a separate pipe which then runs at a spacing from the gas pipe itself. However, it is also possible for the solids to be fed into the molten metal in the form of a wire passing through the gas channel or outlet opening. Thanks to the possibility of guiding the flushing block into a completely closed position relative to the molten metal, there is no need in this embodiment to take additional precautions to prevent the penetration of molten metal into the channel through which the wire is introduced. Obviously, if it is used for introducing powdered solids or for the insertion of wire, the "gas channel" must have a suitable width of opening and the transitional region from the "gas channel" to the outlet opening or openings must be suitably smooth so that the wire can easily be passed through.

The matrix material of the flushing block itself may consist of a refractory ceramic material which is impervious to gas, for example calcined or carbon-bound or carbon-containing refractory oxides. It is also possible, however, to use materials based on zircon dioxide or aluminium oxide or magnesium oxide.

In an embodiment in which the matrix material consists of a porous refractory ceramic material which is pervious to gas, this may itself be used for conveying gas, like conventional flushing blocks, but in this case a gas distribution chamber will preferably be provided below the gas flushing block in known manner, this gas distribution chamber being supplied through a separate gas feed line. The flushing block is then preferably encased in sheet metal, at least in the region of the gas distribution chamber.

The new flushing block may be further developed by various additional constructional features so as to permit additional fields of application.

For example, two gas feed channels may be provided concentrically with one another in the flushing block. The channels will then be formed, for example, by two metal tubes held apart by spacers and both channels or pipes will open laterally into the circumferential surface of the flushing block, the outer pipe being firmly pressed into the refractory matrix material. In this way, a flushing block shape similar to the known OBM nozzle is formed. This flushing block can then be used for oxygen smelting, by blowing oxygen through the inner channel and an inert gas or coolant gas such as propane through the outer annular channel. The gas ensures that combustion damage (manifestations of erosion) caused by the oxygen injected in are avoided both on the refractory material and on the metal pipes. In this connection it is also advantageous for the flushing block to be rotatably mounted. For this purpose, the displacing apparatus also has a rotating apparatus for the flushing block. If in spite of this there is combustion damage, for example in the region of the upper end of the associated sleeve block, this can be stopped by rotating the flushing block through a certain angle. This embodiment presupposes that the flushing block has a circular cylindrical circumferential surface. The flushing block may also be used in conjunction with conventional flushing blocks. Then, for example, a plurality of conventional flushing blocks and a vertically adjustable flushing block according to the invention will be mounted at a spacing from one another in the converter wall and the oxygen flushing block will be connected up to the other flushing blocks as required. In this way, the melting of scrap can be speeded up, for example, and the refining time can be shortened.

It is expressly pointed out that the various constructional measures described hereinbefore can also be implemented in any desired combinations.

Depending on the field of application, any required gases and/or solids can be blown in either through separate channels or together. In addition to treatment with argon or oxygen, treatment with nitrogen should also be mentioned. The solids injected in may be, in addition to those already mentioned, carbon or scale, preferably in powder or dust form.

The vertically adjustable flushing block makes it possible, in particular, to carry out treatment at any desired time and over any length of time. Thus, for example, when it is used in electric arc furnaces, oxygen and/or carbon dust can be blown in only after a liquid sump has been formed. For this purpose, the flushing block is then moved into the open position. By returning it into the closed position the treatment can be interrupted at any time without the risk of molten metal infiltrating the flushing block.

Further features of the invention will become apparent from the other patent claims as well as the remainder of the specification.

Figure 1:
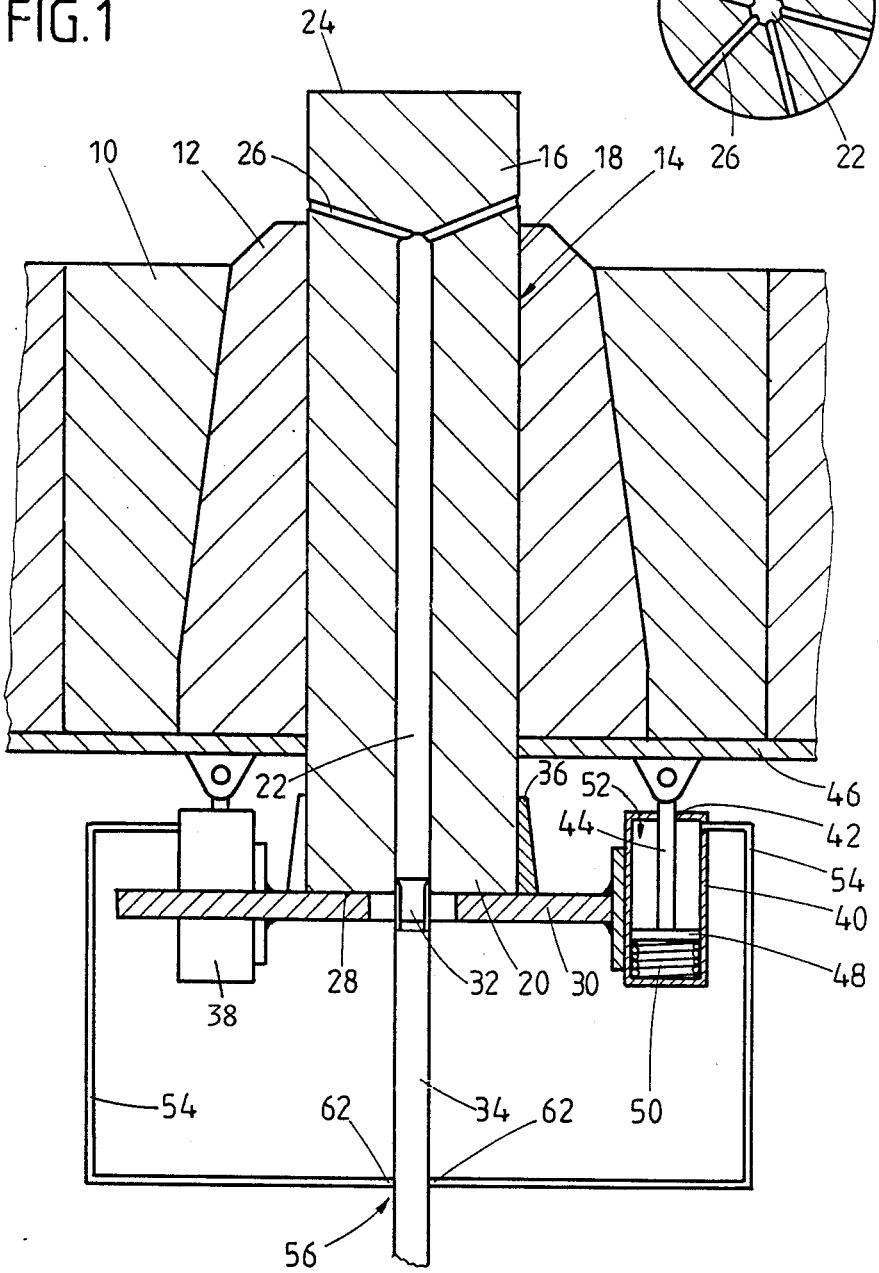
Figure 2:
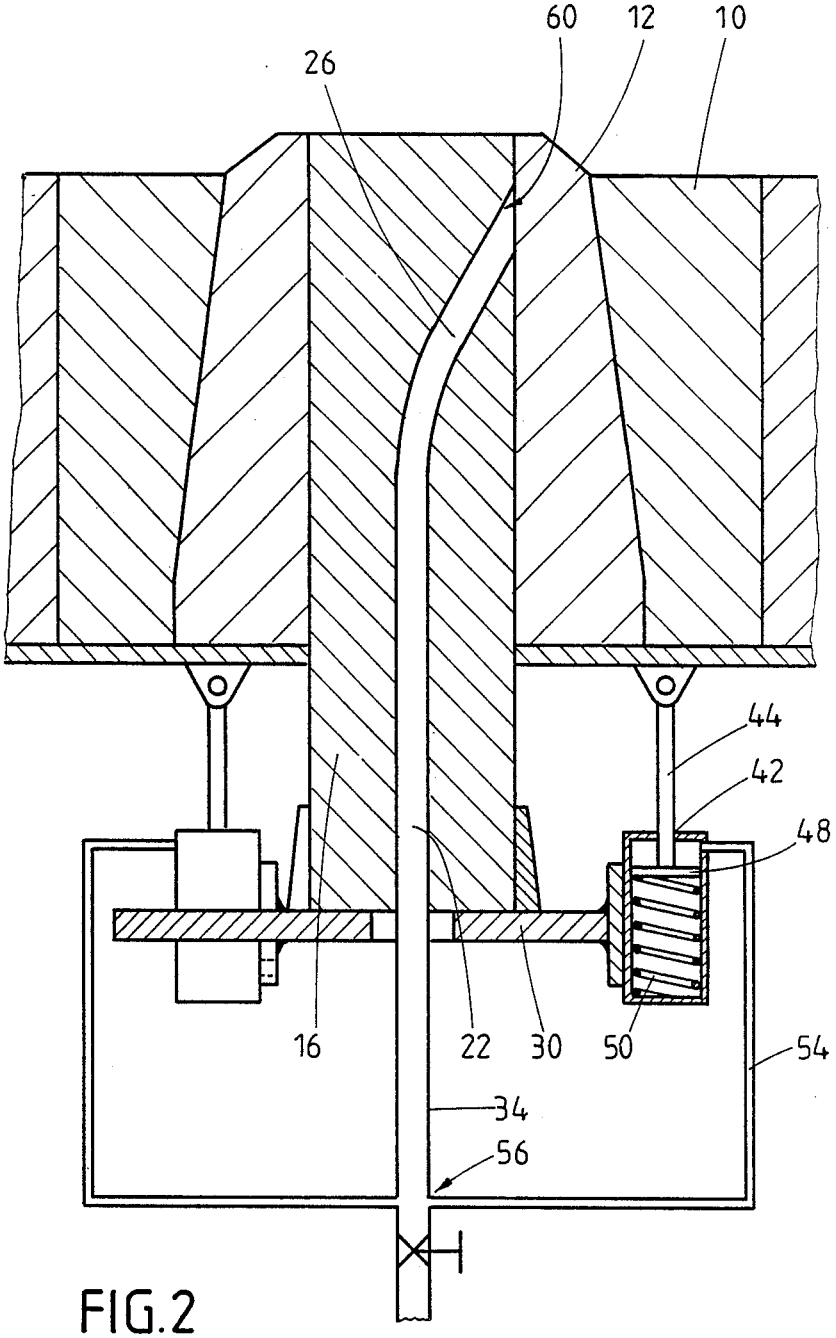
Figure 3:
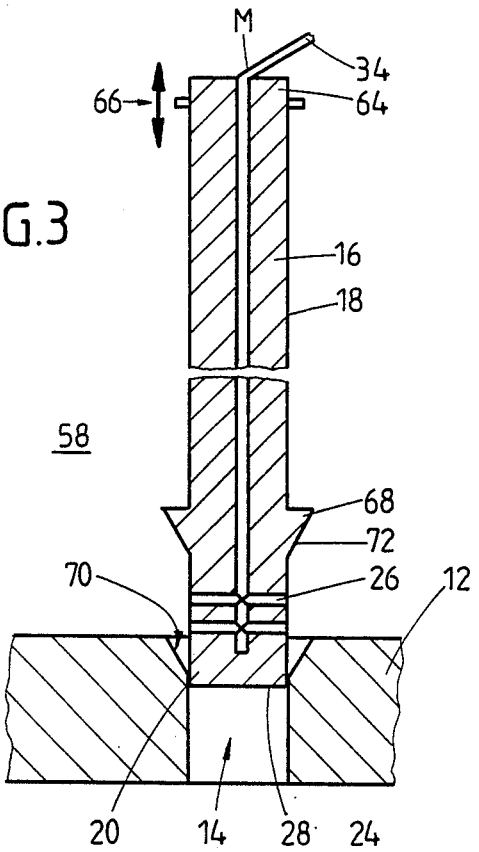
Figure 4:
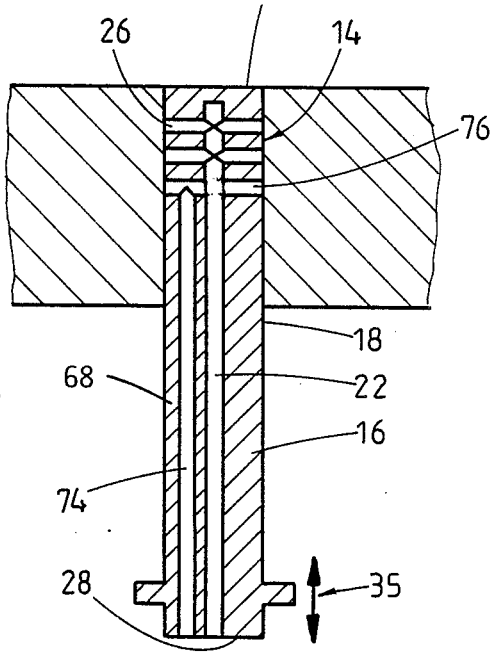
Figure 5:
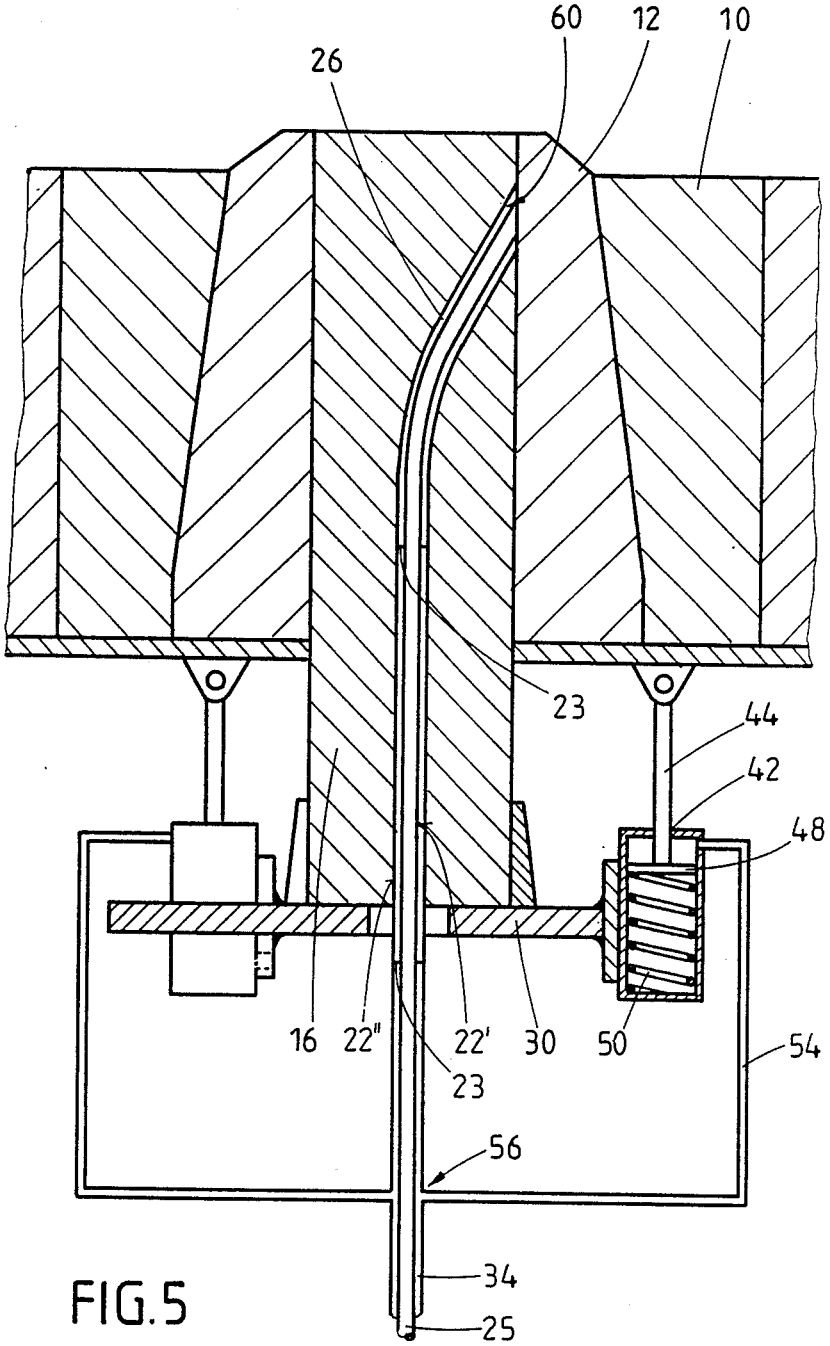

The drawing shows, in highly diagrammatical sectional view, various embodiments of the gas flushing block according to the invention, namely in FIG. 1 a first embodiment of the apparatus in association with a sleeve block in the open position, and in FIG. 2 an alternative embodiment of the apparatus in the closed position, in FIG. 3 an embodiment which is to be inserted in a sleeve block from above, and in FIG. 4 an example of a gas flushing block which simultaneously forms an outlet valve, and in FIG. 5 a flushing block for oxygen smelting.

In the Figures, the same reference numerals are used for components performing the same function.

In FIG. 1, reference numeral 10 denotes the base of a melting ladle, in the outlet of which is placed a sleeve block 12 in known manner. The sleeve block 12 has a central cylindrical through-opening 14.

In the through-opening 14 is located a cylindrical flushing block 16, the cross-section of which is such that its circumferential surface 18 does indeed abut closely on the corresponding inner surface of the through-opening 14 of the sleeve block 12 but is still vertically movable by sliding in the through-opening 14.

From the lower end 20, a gas channel 22 extends vertically upwards along the central longitudinal axis and the gas channel 22 ends at a spacing from the upper end face 24 of the flushing block 16. As is clear particularly from the sectional view in the top right-hand corner (FIG. 1*a*), a total of six outlet openings 26 in the form of channels extend from the upper end of the gas channel 22 in a substantially radial direction and with a slight inclination relative to the upper end face 24 down to the circumferential surface 18.

The flushing block 16 abuts with its lower end face 28 on a plate 30 which comprises, on an extension of the gas channel 22, an opening 32 in which a gas pipe 34 is connected to the gas channel 22. At a spacing from the opening 32, a cylindrical connector 36 extends from the surface of the plate 30, the internal diameter of said connector 36 being somewhat greater than the external diameter of the flushing block 16. The flushing block 16 is firmly cemented in the connector 36.

Three pneumatic cylinders 38 evenly spaced from one another are welded onto the circumferential surface of the circular disc-shaped plate 30. The pneumatic cylinders 38 consist of a receiving cylinder 40 having an opening 42 at the top through which a piston 44 passes, the piston 44 being guided in gas-tight manner relative to the opening 42. The piston 44 is secured at its upper end to a plate 46 provided below the base 10. At its lower end situated in the cylinder 40, the piston 44 has a disc 48 which abuts in gas-tight manner but displaceably relative to the inner wall of the cylinder 40. Between the underside of the disc 48 and the base of the cylinder 40 is a compression spring 50, shown in its compressed state here.

A further gas pipe 54, which communicates with the main gas pipe 34 at 56, opens into the space 52 formed between the top of the disc 48 and the end of the cylinder 40, just below the end.

The position of the spring 50 shown is achieved when gas is fed into the chamber 52 through the gas pipes 34, 54, the gas pressure being so high that it overcomes the bias of the spring 50, as a result of which the plate 30 fixed to the cylinder 40 and hence the flushing block 16 are simultaneously moved upwards into the open position shown in FIG. 1, in which the outlet openings 26 project into the molten metal 58 above the upper end of the flushing block 12.

In this position, through the gas pipe 34, gas can be forced not only into the cylinders 40 through the additional gas pipes 54 but also through the gas channel 22 and the outlet openings 26 into the molten metal.

Since the actuating device (piston/cylinder arrangement 40, 44) can only be moved into the position shown when the gas pressure applied is greater than the ferrostatic pressure in the melting vessel, this simultaneously ensures that the stream of inert gas injected through the outlet openings 26 is under such a high pressure that the molten metal is reliably prevented from entering the outlet openings 26.

By simply reducing the gas pressure in the gas pipe 34, the plate 30 is lowered again, by the biasing of the springs 50, and in this way the flushing block 16 is moved into the closed position shown in FIG. 2. The disc 48 has then reached its highest position within the cylinder 40, but there is still a space 52 into which the gas pipe 54 opens.

The supply of gas into the molten metal is now stopped and the flushing block 16 abuts with its circumferential surface 18 forming a complete seal relative to the inner surface of the through-opening 14 of the sleeve block 12. Infiltration by the molten metal is safely prevented because there is no space between the flushing block and the sleeve block.

The actual construction of the flushing block 16 in FIG. 2 is somewhat different from that in FIG. 1. As can easily be seen from FIG. 2, the gas channel 22 is guided towards the circumferential surface 18, at a spacing from the upper end face 24, and opens into the circumferential surface 18 at 60, the last portion 26 corresponding functionally to the outlet openings 26 in FIG. 1.

As can be seen from FIG. 2, the gas channel 22 here opens into only one outlet opening 26, this embodiment being intended particularly for the insertion of an alloy wire which can easily be passed through the gas channel 22 and outlet opening 26 and at the same time is surrounded by the current of gas.

The embodiments shown by way of example in FIGS. 1 and 2 may, however, also be used for the introduction of powdered reagents and additives, which will be discharged with the current of gas (FIG. 1). In this case, solids filters 62 are arranged at 56 in the transitional area between the gas pipe 34 and the gas pipes 54, to ensure that the particles of solids do not enter the gas pipes 54. Of course, the gas pipes 34, 54 may also be supplied by separate gas feed lines.

In the embodiments shown by way of example in FIGS. 1 and 2 the flushing block 16 consists of a compressed zircon dioxide material which makes it possible to produce the flushing block with a particularly smooth surface enabling the flushing block 16 to abut closely on the sleeve block 12, preferably also consisting of zircon dioxide, to form a tight seal.

FIG. 3 shows an embodiment in which the flushing block 16 is like a stopper in construction and is introduced into the sleeve block 12 from above. The gas channel 22 extends from the upper end 64 axially downwards and ends at a spacing from the lower end face 28. Reversing the arrangement shown in the embodiments illustrated in FIGS. 1 and 2, the outlet openings 26 in this case extend at the lower end of the gas channel 22 laterally to the circumferential surface 18.

At the upper end 64, a gas pipe 34 adjoins the gas channel 22 and the flushing block 16 is articulated at 64 to a displacing apparatus 66 (shown diagrammatically) by means of which the flushing block 16 can be moved vertically up and down.

The arrangement of the flushing block 16 relative to the sleeve block 12 is such that the flushing block is always located with its lower end 20 in the through-opening 14 of the sleeve block 12. This ensures that it is safely guided.

Above the outlet openings 26, the flushing block is formed with a frusto-conical thickened portion 68, whilst the sleeve block 12 has at its upper end a correspondingly shaped recess 70.

This construction ensures that, when the flushing block 16 is lowered by means of the displacing apparatus 66, not only are the outlet openings 26 sealed off by abutment on the inner wall of the sleeve block 12 in the region of the through-opening 14, but at the same time the flushing block 16 abuts with its conical circumferential surface 72 in the region of the thickened portion 68 on the corresponding surface of the recess 70, thus achieving a particularly secure seal.

FIG. 4 shows an embodiment of the flushing block in which it is simultaneously used as a closure plug.

For this purpose, the gas channel 22 is somewhat offset from the central longitudinal axis M of the flushing block 16, but in every other respect is constructed as in the embodiment shown in FIG. 1.

Offset parallel to the gas channel 22, another channel 74 extends from the lower end face 28, this channel 74 also ending at a spacing from the upper end face 24 but somewhat below the gas channel 22. From the upper end of the other channel 74 there run a total of six feed openings 76, uniformly distributed over the cross-section, so that the gas channel 22 projects between two feed openings 76. The openings 76 in turn open into the circumferential surface 18 of the flushing block 16.

In the view shown in FIG. 4, the flushing block 16 is in its lowest position, i.e. the feed openings 76 and the outlet openings 26 abut closely on the inner wall of the through-opening 14 of the sleeve block 12 and gas cannot escape through the outlet openings 26 nor can molten metal penetrate through the feed openings 76.

However, if the flushing block is moved upwards using a displacing apparatus (arrow 35), the outlet openings 26 are first exposed, i.e. gas flows into the molten metal, and as the flushing block 16 continues to move upwards the feed openings 76 also reach the area above the sleeve block 12, so that molten metal can flow through them into the additional channel 74. The molten metal then runs downwardly and out through the channel 74. Depending on how far the flushing block 16 is moved, it is therefore possible either to carry out a flushing operation only or to use the flushing block 16 as a regulator valve for the outflow of molten metal.

Similarly, it is of course possible to arrange the feed openings 76 for the molten metal above the outlet openings 26 for the gas.

In this embodiment, therefore, the flushing block can perform two functions and it is no longer necessary, as in the prior art, to provide on the one hand a closure device for the outlet of a metallurgical melting vessel through which the molten metal can be drawn off and, on the other hand, to provide a gas flushing unit but instead both can be combined in a ceramic moulding. The advantages of this are clear, particularly as it is possible to carry out a separate flushing operation and/or remove molten metal from the metallurgical vessel, as already described. In this embodiment, the channel 74 can also alternatively be used for blowing in a mixture of gas and solids. For this purpose, the lower end of the channel 74 is then connected to a corresponding gas/solids feed line. The channel 74 can be constructed like the channel 22, 26 in FIG. 2.

FIG. 5 shows a flushing block for oxygen smelting. Unlike in FIG. 2, the channel 22, 26 is of double-walled construction in this case and consists of two concentric metal pipes 22' and 22'', spaced apart by rod-shaped spacers 23. Alternatively, the inner pipe 2'' might have a helically extending ridge, similar to a screw thread, over its outer surface. The outer pipe 22'' is fixed during the pressing of the refractory ceramic matrix material or may be adhesively bonded or cemented in later on. The outer pipe 22'' is connected to the pipe 34 for inert gas (for example argon), whilst the inner pipe 22' is supplied with oxygen from an oxygen source at 25. Once the flushing block has been moved into a position as shown in FIG. 1, oxygen is injected through the tube 22' and argon through the annular channel between the pipes 22' and 22'' into the molten metal. Otherwise, all the remarks applying to the other embodiments apply here.

Within the scope of the invention it is possible to devise other alternative embodiments. Thus, for example, the actuating means for the flushing block may also be electrically or hydraulically operated. It is particularly possible to develop the mechanism for moving a slide closure by means of a turning transmission so that, instead of a horizontal movement, a vertical movement can be performed, which means that known mechanical apparatus would only require slight modification in order to be used to actuate a flushing block according to the invention.

Contrary to what is shown in the drawings, the plate 46 may also extend only as far as the sleeve block 12, in order to make it easier to replace or remove the flushing system. Also, the device 68 shown in FIG. 4 may be provided at the upper end of the flushing block according to FIGS. 1 or 2 or 5, in which case the sleeve block would be chamfered accordingly.

The apparatus may also be used, for example, for vacuum treatment in a ladle or the like.

The flushing block may have a metal casing at least over its portion near the connection. The flushing block has in this region a cross-section which is reduced by the thickness of the metal casing and, if applicable, by an intermediate mortar.

We claim:

1. Flushing block having a circumferential surface for introducing gases alone or together with solid reagents and additives into a metallurgical melting vessel, said flushing block being connectable to at least one drive means, said flushing block having at a first end an inlet opening, and at its opposite second end having at least one outlet opening extending from the circumferential surface of said flushing block, gas channel means formed in said flushing block extending longitudinally through said flushing block and connecting the outlet opening with the inlet opening for conveying gases alone or together with solid reagents and additives through said flushing block to the interior of the metallurgical melting vessel, and means at the inlet opening of the gas channel means for connecting the gas channel means to a gas supply pipe.

2. Flushing block according to claim 1, in which at least one additional channel (74) is provided at a spacing from the gas channel means (22) and the outlet opening or openings (26) thereof, said additional channel (74) merging, at a spacing from its open end, into at least one feed opening (76) which is open towards the circumferential surface (18).

3. Flushing block according to claim 2, wherein the additional channel (74) extends from the lower end (28) of the flushing block to just before the opposite end face (24) of the flushing block.

4. Flushing block according to one of claim 2, wherein the feed opening or openings (76), viewed in the axial direction of the flushing block, is or are offset relative to the or each outlet opening (26).

5. Flushing block according to claim 2, wherein the feed opening or openings (76) or the outlet opening or openings (26) extend substantially radially of the circumferential surface (18) of the flushing block.

6. Flushing block according to claim 2, wherein the gas channel means (22) or the additional channel (74) extend parallel to the central longitudinal axis (M) of the flushing block.

7. Flushing block according to claim 1, wherein the flushing block is formed with a thickened portion (68) above the portion provided with the outlet or feed openings (26, 76).

8. Flushing block according to claim 1 having a portion formed along the longitudinal dimension thereof, to which an actuating apparatus (40, 44) can be connected, which is vertically (displaceably) movable, viewed in the axial direction of said channel, or which rotates the flushing block about its central longitudinal axis.

9. Flushing block according to claim 8, wherein the actuating apparatus (40, 44) consists of a plurality of prestressed pneumatic cylinders (40) which, when a predetermined pressure is reached move the flushing block upwards until the outlet or feed openings (26, 76) are exposed relative to the melt (58) in the metallurgical melting vessel and, when the pressure falls, lower the flushing block until its outlet or feed openings (26, 76) abut closely on the refractory material of the base which receives the flushing block or on the wall of the metallurgical melting vessel.

10. Flushing block according to claim 1, wherein the gas channel means (22) is formed from two concentric pipes (22', 22'') which can be connected to separate gas feed lines (25, 34).

11. Flushing block according to claim 1, having a metal casing at least over its portion near the connection, the flushing block having in this region a cross-section which is reduced by the thickness of the metal casing and if applicable by an intermediate mortar.

12. Flushing block having a circumferential surface for introducing gases alone or together with solid reagents and additives into a metallurgical melting vessel, said flushing block being connectable at a first end to a gas pipe and at least to one drive means and at its opposite second end having at least one outlet opening extending from its circumferential surface, said opening communicating with at least one gas channel, said gas channel extending from said opening longitudinally through said flushing block to said first end and being connectable at said first end to the gas pipe, in which at least one additional channel is provided at a spacing from the gas channel and the outlet opening or openings thereof, said additional channel merging, at a spacing from its open end, into at least one feed opening which opens towards the circumferential surface, wherein the additional channel extends from the lower end of the flushing block to just before the opposite end face of the flushing block, wherein the feed opening or openings, viewed in the axial direction of the flushing block, is or are offset relative to the or each outlet opening, wherein the feed opening or openings or the outlet opening or openings extend substantially radially of the circumferential surface of the flushing block, wherein the gas channel or the additional channel extend parallel to the central longitudinal axis (M) of the flushing block, wherein the outlet opening or openings or the feed opening or openings are constructed as slots which extend substantially axially with respect to the flushing block, wherein the flushing block is formed with a thickened portion above the portion provided with outlet or feed openings, further including a portion formed along the longitudinal dimension of the flushing block, to which an actuating apparatus can be connected, which is vertically (displaceably) movable, viewed in the axial direction of said channel, or which rotates the flushing block about its central longitudinal axis, wherein the actuating apparatus consists of a plurality of prestressed pneumatic cylinders which, when a predetermined pressure is reached, move the flushing block upwards until the outlet or feed openings are exposed relative to the melt in the metallurgical melting vessel and, when the pressure falls, lower the flushing block until its outlet or feed openings abut closely on the refractory material of the base which receives the flushing block or on the wall of the metallurgical melting vessel, wherein the gas channel is formed from two concentric pipes which can be connected to separate gas feed lines, and further including a metal casing at least over its portion near the connection, the flushing block having in this region a cross-section which is reduced by the thickness of the metal casing and if applicable by an intermediate mortar.

13. A flushing block which fits in an opening in a wall of a metallurgical melting vessel for introducing gases alone or together with solid reagents and additives into the metallurgical melting vessel, having an outlet opening formed in a sidewall of the flushing block near the top of the flushing block which extends inwardly toward the center of the flushing block, a gas channel formed in the flushing block which extends longitudinally through the flushing block and which connects the outlet opening with the bottom of the flushing block, means connected to the gas channel at the bottom of the flushing block for supplying gas to the gas channel, and drive means connected to the flushing block for moving the flushing block from a closed position where the flushing block is seated in the wall of the metallurgical melting vessel so that thickness of the wall covers the outlet opening and prevents gas from escaping into the metallurgical melting vessel, to an open position where the block extends into the metallurgical melting vessel to supply gas to the interior of the metallurgical melting vessel.

14. A flushing block which fits in an opening in a wall of a metallurgical melting vessel, for introducing gases alone or together with solid reagents and additives to the metallurgical melting vessel, having an outlet opening formed in a sidewall of the flushing block near the top of the flushing block and which extends inwardly toward the center of the flushing block, a gas channel formed in the flushing block which extends longitudinally through the flushing block and which connects the outlet opening with the bottom of the flushing block, means connected to the gas channel at the bottom of the flushing block for supplying gas to the gas channel, drive means connected to the flushing block for moving the flushing block from a closed position where the flushing block is seated in the wall of the metallurgical melting vessel so that the thickness of the wall covers the outlet opening and prevents gas from escaping into the metallurgical melting vessel, and an open position where the block extends into the metallurgical melting vessel to supply gas to the interior of the metallurgical melting vessel, at least one further channel being provided in the flushing block at a spacing from the gas channel and the outlet opening thereof, said additional channel merging, at a spacing from its open end, into a feed opening which opens towards the sidewall of the flushing block, wherein the additional channel extends from the bottom of the flushing block to near the top of the flushing block, wherein the feed opening, viewed in the axial direction of the flushing block, is offset relative to the outlet opening, wherein the feed opening and the outlet opening extend substantially radially inwardly from the side wall of the flushing block, wherein the gas channel or the additional channel extend parallel to the central longitudinal axis (M) of the flushing block, wherein the outlet opening or the feed opening are constructed as slots which extend substantially axially with respect to the flushing block, wherein the flushing block is formed with a thickened portion above the portion provided with the outlet opening or feed opening, the flushing block further including a portion formed along its longitudinal dimension to which an actuating apparatus may be connected and which is vertically (displaceably) movable when viewed in the axial direction of said channel, or which rotates the flushing block about its central longitudinal axis, wherein the actuating apparatus consists of a plurality of prestressed pneumatic cylinders which, when a predetermined pressure is reached, move the flushing block upward until the outlet opening or feed opening is exposed to the melt in the metallurgical melting vessel and, when the pressure falls, lower the flushing block until its outlet or feed opening abuts closely on the wall of the metallurgical melting vessel, wherein the gas channel is formed from two concentric pipes which may be connected to separate gas feed lines, and the flushing block further including a metal casing at least over its portion near the connection, the flushing block having in this region a cross-section which is reduced by the thickness of the metal casing and, if applicable, by an intermediate mortar.

15. Flushing block having a circumferential surface for introducing gases alone or together with solid reagents and additives into a metallurgical melting vessel, said block being connected to at least one drive means connected at a first end to a gas pipe and at its opposite second end having at least one outlet opening, said outlet opening extending from the circumferential surface of said block, said opening communicating with at least one gas channel, said gas channel extending from said opening longitudinally through said flushing block to said first end.

16. Flushing block for introducing gases alone or together with solid reagents and additives into a metallurgical vessel having a first end for receiving a gas pipe and at least one drive means and at its opposite second end having at least one outlet opening, extending from its circumferential surface, said opening connecting with at lest one gas channel, said gas channel extending from said opening longitudinally through said flushing block to said first end, and means at the inlet opening of the gas channel for connecting the gas channel to a gas supply pipe.

* * * * *